US008336871B2

(12) United States Patent
Liao et al.

(10) Patent No.: US 8,336,871 B2
(45) Date of Patent: Dec. 25, 2012

(54) PAPER FEEDING MECHANISM

(75) Inventors: Ching-Feng Liao, New Taipei (TW); Yung-Kai Chen, New Taipei (TW); Wen-Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/315,467

(22) Filed: Dec. 9, 2011

(65) Prior Publication Data

US 2012/0256366 A1 Oct. 11, 2012

(30) Foreign Application Priority Data

Apr. 8, 2011 (TW) ..... 100206220

(51) Int. Cl.
*B65H 5/00* (2006.01)

(52) U.S. Cl. ..... 271/10.04; 271/10.11

(58) Field of Classification Search ..... 271/4.01, 271/4.04, 4.08, 4.1, 10.01, 10.04, 10.09, 271/10.11
See application file for complete search history.

(56) References Cited

U.S. PATENT DOCUMENTS 6,601,843 B2 * 8/2003 Miki ..... 271/10.13
6,974,127 B2 * 12/2005 Kang ..... 271/10.11
8,172,217 B2 * 5/2012 Tamura et al. ..... 271/4.04

* cited by examiner

*Primary Examiner* — Michael McCullough
(74) *Attorney, Agent, or Firm* — WPAT, P.C.; Anthony King

(57) ABSTRACT

A paper feeding mechanism mounted to a shell includes a pickup mechanism, a transporting mechanism, a separation mechanism and a one-way clutch mechanism. The pickup mechanism includes a pickup motor having a rotating roller, a pickup roller and a pickup wheel. The transporting mechanism includes a transporting motor, a transporting roller, a transporting wheel and a transporting gear. The separation mechanism includes a separation roller, a separation gear and a separation wheel. The one-way clutch mechanism includes a one-way axle, a wiggling arm, a restoration elastic element fastened between the wiggling arm and the shell, and a releasing gear. The one-way axle passes through one end of the wiggling arm. The rotating roller of the pickup motor passes through the one-way axle. The releasing gear mounted to the other end of the wiggling arm is engaged with the transporting gear and the separation gear.

9 Claims, 6 Drawing Sheets

PAPER FEEDING MECHANISM

BACKGROUND OF THE INVENTION

1. Field of the Invention

The present invention generally relates to a paper feeding mechanism, and more particularly to a paper feeding mechanism capable of improving a paper feeding speed.

2. The Related Art

Referring to FIG. 8, a paper feeding mechanism used in an office equipment, such as a scanner or a multi-functional peripheral, generally includes a transporting mechanism and a pickup mechanism. The transporting mechanism includes a transporting motor 71, and a plurality of transporting wheels 72 driven by the transporting motor 71. The pickup mechanism includes a pickup motor 81, a separation wheel 82 and a pickup wheel 83 driven by the pickup motor 81. When a piece of paper needs to be fed into the office equipment, if there is no paper located under the pickup wheel 83, the pickup motor 81 drives the pickup wheel 83 to pick up papers, and then drives the separation wheel 82 to separate the papers into the transporting mechanism. Finally, the transporting motor 71 drives the transporting wheels 72 to feed one piece of paper into the paper feeding mechanism. If there are some papers remained under the pickup wheel 83 after feeding the one piece of paper into the paper feeding mechanism in the last time, the pickup motor 81 drives the separation wheel 82 to separate the papers into the transporting mechanism, then the transporting motor 71 drives the transporting wheels 72 to ensure another one piece of paper to be fed into the paper feeding mechanism.

However, in the process of feeding the papers into the paper feeding mechanism, the separation wheel 82 and the pickup wheel 83 are driven by the pickup motor 81 to sometimes rotate and sometimes stop. When there are some papers remained under the pickup wheel 83 after feeding the one piece of paper into the paper feeding mechanism in the last time, the transporting motor 71 could keep driving the transporting wheels 72 to feed another one piece of paper into the paper feeding mechanism, but the pickup motor 81 need be restarted to drive the separation wheel 82 to separate the papers into the transporting mechanism. As a result, a rotating speed of the separation wheel 82 is different from that of the transporting wheel 72 so that results in a time interval between each two pieces of papers fed to the paper feeding mechanism. Furthermore, the separation wheel 82 will cause a time delay from restarting to accelerating the pickup motor 81 that further increases the time interval between each two pieces of papers fed to the paper feeding mechanism and lowers a paper feeding speed. Moreover, if another driving motor is specially used to drive the separation wheel 82, cost of electricity and components of the paper feeding mechanism will increase, and the paper feeding mechanism will occupy a larger space in the office equipment.

SUMMARY OF THE INVENTION

An object of the present invention is to provide a paper feeding mechanism. The paper feeding mechanism includes a pickup mechanism, a transporting mechanism, a separation mechanism and a one-way clutch mechanism. The pickup mechanism mounted to a shell includes a pickup motor having a rotating roller, a pickup roller driven by the pickup motor, and a pickup wheel mounted around the pickup roller. The transporting mechanism mounted to the shell includes a transporting motor, at least one transporting roller driven by the transporting motor, a plurality of transporting wheels mounted around the transporting roller, and a transporting gear mounted to one end of the transporting roller. The separation mechanism mounted to the shell and driven by the transporting motor includes a separation roller, a separation gear mounted to one end of the separation roller, and a separation wheel mounted to the other end of the separation roller. The one-way clutch mechanism mounted to the shell includes a one-way axle, a wiggling arm, a restoration elastic element and a releasing gear. The one-way axle passes through one end of the wiggling arm. The rotating roller of the pickup motor passes through the one-way axle to fasten the one end of the wiggling arm to the rotating roller of the pickup motor. The other end of the wiggling arm is rotatably mounted to the shell. The restoration elastic element is fastened between the wiggling arm and the shell. The releasing gear is mounted to the other end of the wiggling arm, and is engaged with the transporting gear and the separation gear.

As described above, the paper feeding mechanism depends on the one-way clutch mechanism being rotatably mounted to the shell to realize the transporting motor to synchronously drive the transporting gear and the separation wheel to rotate continuously. As a result, paper feeding time is saved to decrease a space between each two pieces of the papers fed to the paper feeding mechanism so as to improve a paper feeding speed. Therefore, the paper feeding mechanism uses fewer components to design a proper structure to realize a better working performance.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
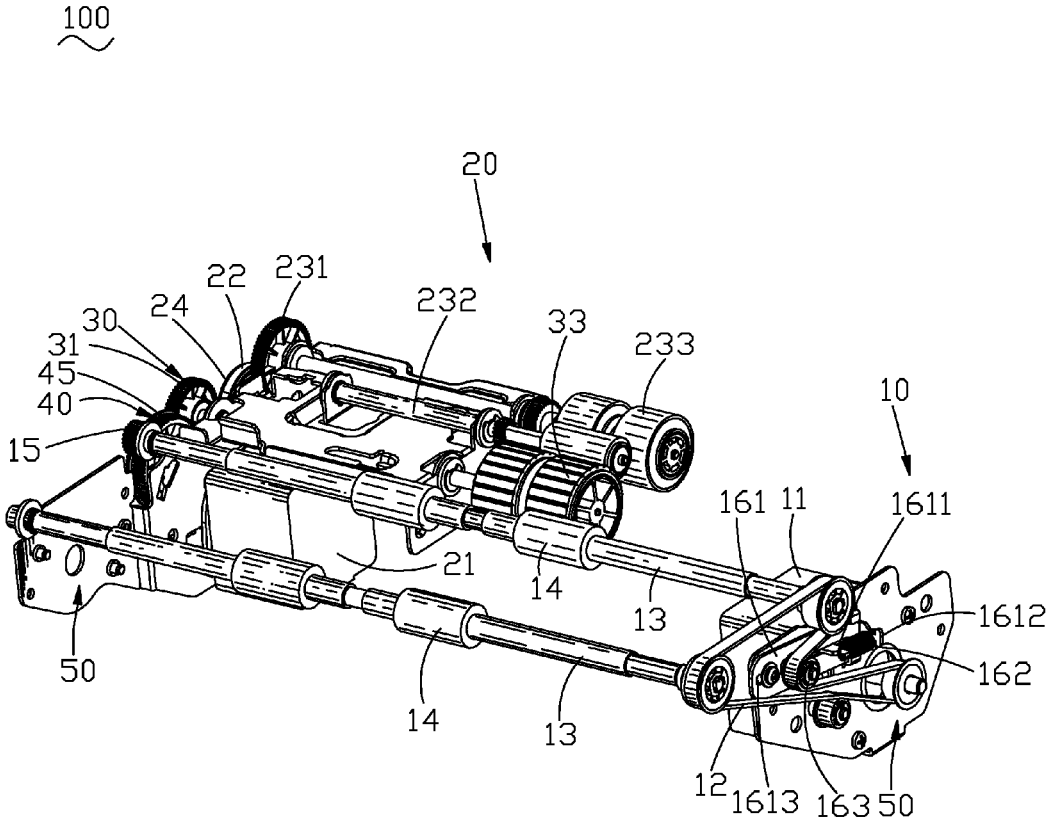
FIG. 1 is a perspective view of an embodiment of a paper feeding mechanism in accordance to the present invention.
Figure 3:
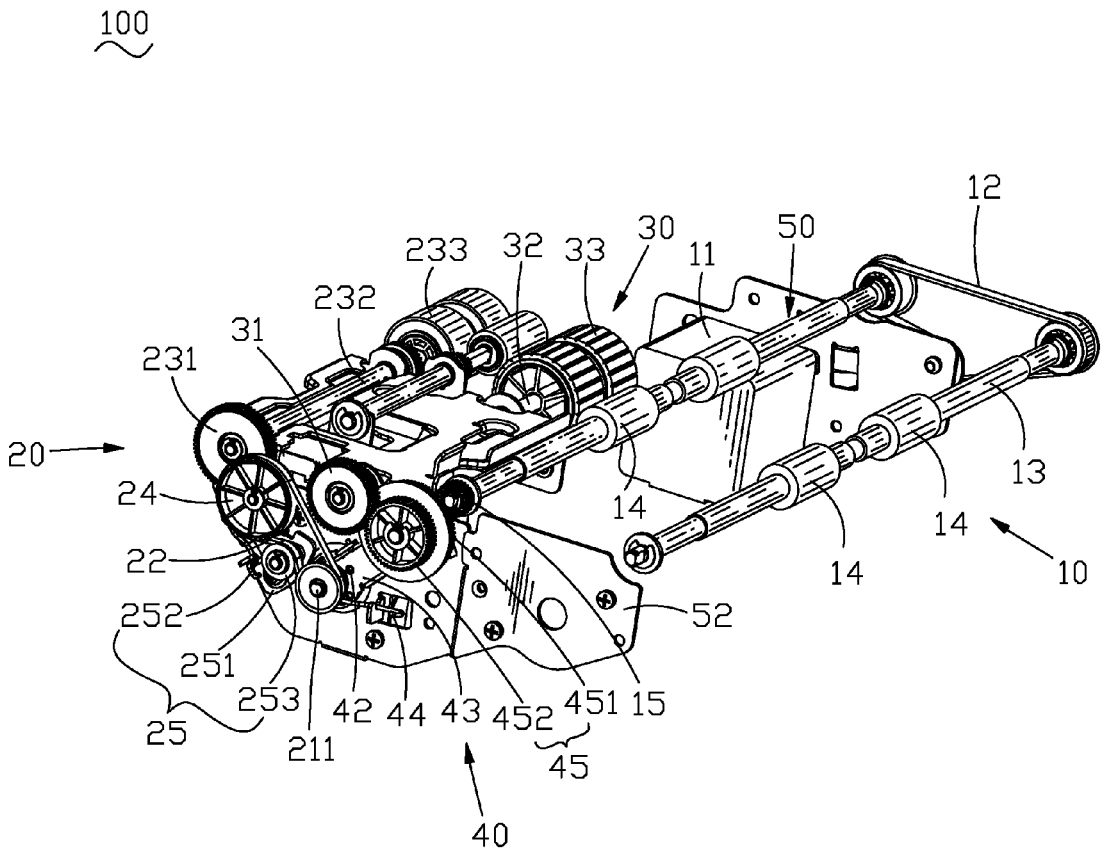
FIG. 3 is another perspective view of the paper feeding mechanism of FIG. 1.

With reference to FIG. 1 and FIG. 3, an embodiment of a paper feeding mechanism 100 which is used in a scanner (not shown) or a multi-functional peripheral (not shown) in accordance with the present invention is shown. The paper feeding mechanism 100 mounted in a shell 50 includes a transporting mechanism 10, a pickup mechanism 20, a separation mechanism 30 and a one-way clutch mechanism 40. The shell 50 includes a first shell 51 disposed in a front of the paper feeding mechanism 100, and a second shell 52 disposed in a rear of the paper feeding mechanism 100.

Figure 2:
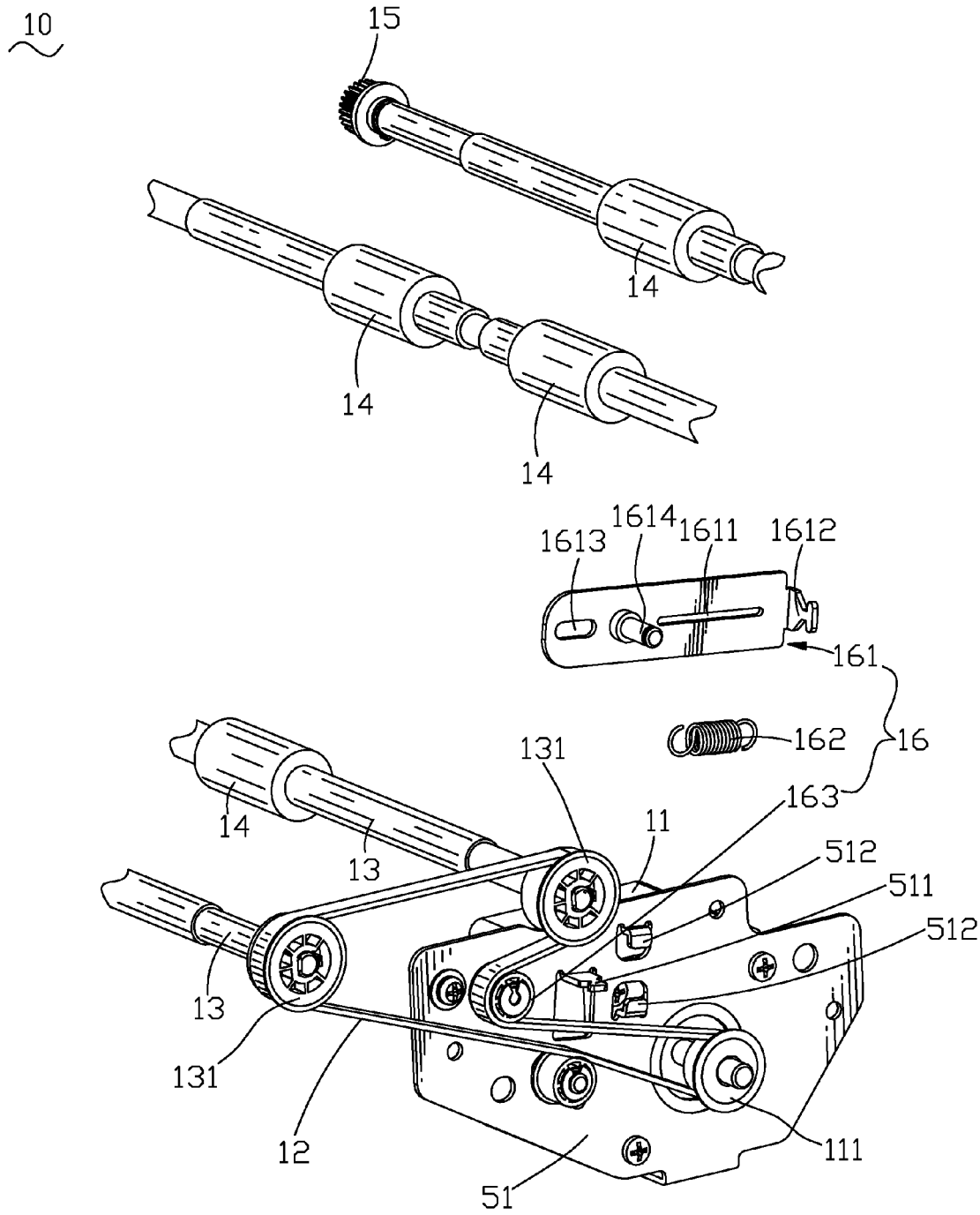
FIG. 2 is an exploded view of a transporting mechanism of the paper feeding mechanism of FIG. 1.

Referring to FIG. 1 and FIG. 2, the transporting mechanism 10 mounted to the shell 50 includes a transporting motor 11, a transporting conveyer 12 driven by the transporting motor 11, a pair of transporting rollers 13 driven by the transporting conveyer 12, a plurality of transporting wheels 14 mounted around the transporting rollers 13, a transporting gear 15 mounted to one end of the transporting roller 13, and a transporting pressing belt mechanism 16.

The transporting motor 11 is mounted to a rear side of the first shell 51 of the shell 50. One side of the first shell 51 is punched forward to define a guiding piece 511 perpendicular to the shell 50. Two portions of a middle of the first shell 51 are punched forward to define two L-shaped clamping pieces 512 disposed face to face. The transporting pressing belt mechanism 16 includes a transporting pressing board 161, a transporting elastic element 162 and a transporting pressing wheel 163. One end of the transporting pressing board 161 defines a guiding slot 1611. A middle of the one end edge of the transporting pressing board 161 is bent forward to define a blocking piece 1612. The other end of the transporting pressing board 161 defines a limiting slot 1613. A first pillar 1614 is protruded forward from a front of the transporting pressing board 161 and located between the guiding slot 1611 and the limiting slot 1613. The one end of the transporting pressing board 161 is positioned between the two clamping pieces 512. The guiding piece 511 is inserted into the guiding slot 1611. A limiting element (not labeled) passes through the limiting slot 1613 to slidably dispose the other end of the transporting pressing board 161 to a front side of the first shell 51. One end of the transporting elastic element 162 hooks the blocking piece 1612, and the other end of the transporting elastic element 162 hooks the guiding piece 511. The transporting pressing wheel 163 is mounted around the first pillar 1614. A front end of the transporting roller 13 is equipped with a rotating wheel 131. The transporting conveyer 12 is looped around a first rotating roller 111 of the transporting motor 11 and the rotating wheels 131. An outside of the transporting pressing wheel 163 slidably presses the transporting conveyer 12. The transporting elastic element 162 of the transporting pressing belt mechanism 16 moves telescopically to drive the transporting pressing board 161 of the transporting pressing belt mechanism 16 reciprocated along the guiding slot 1611 and the limiting slot 1613 so as to elastically modulate tightness extent of the transporting conveyer 12. The transporting motor 11 drives the transporting conveyer 12 to bring along the transporting wheels 14 and the transporting gear 15 to rotate along a counter-clockwise direction.

Referring to FIG. 1, FIG. 3, FIG. 4 and FIG. 6, the pickup mechanism 20 mounted to the shell 50 includes a pickup motor 21, a pickup conveyer 22 driven by the pickup motor 21, a passive wheel 24 driven by the pickup conveyer 22, a pickup gear 231 engaged with the passive wheel 24, a pickup roller 232 mounted in a middle of the pickup gear 231, a pickup wheel 233 mounted around the pickup roller 232, and a pickup pressing belt mechanism 25. The pickup motor 21 is mounted to a front side of the second shell 52 of the shell 50. A side edge of the second shell 52 is punched rearward to define a hooking piece 524. A pivoting pillar 523 is protruded rearward from the second shell 52 and located adjacent to the hooking piece 54. A middle of the passive wheel 24 protrudes towards the rear side of the second shell 52 to form a tooth portion 241 to be mounted to the rear side of the second shell 52.

Figure 4:
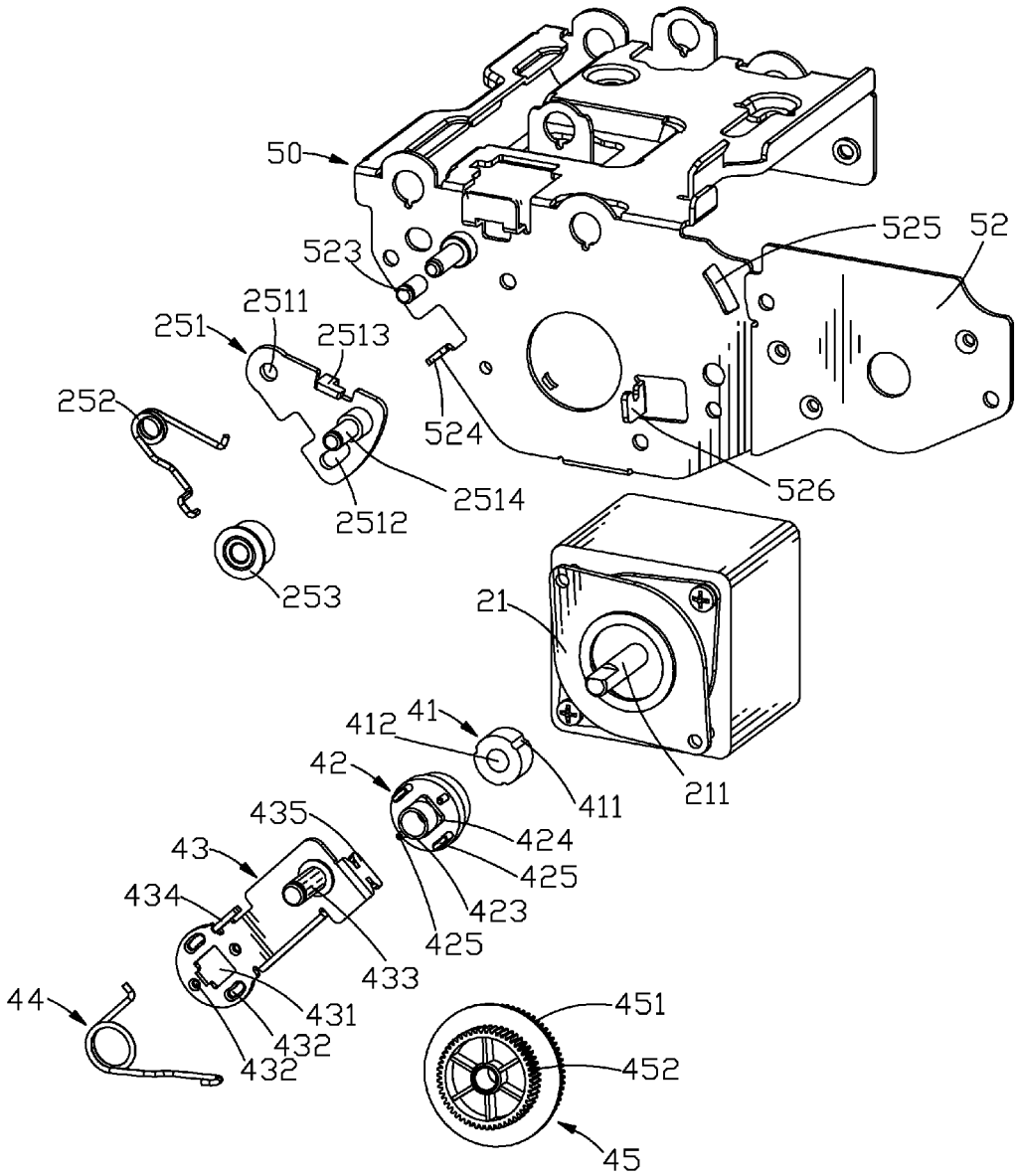
FIG. 4 is an exploded view of a one-way clutch mechanism, parts of a pickup belt pressing mechanism, and a shell of the paper feeding mechanism of FIG. 1.
Figure 5:
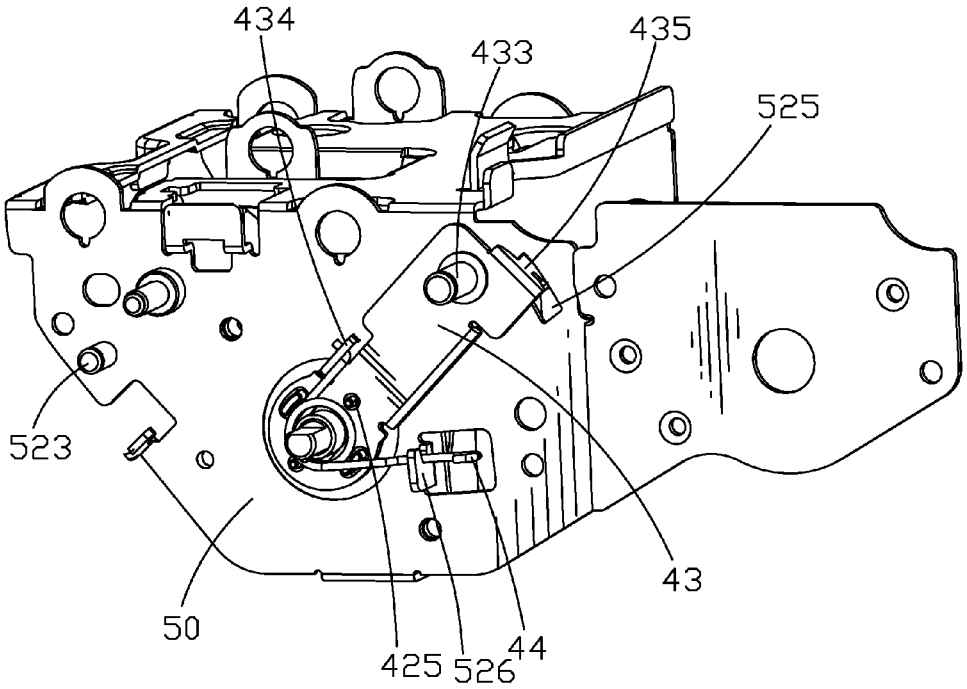
FIG. 5 is a perspective view of the one-way clutch mechanism assembled in the shell of the paper feeding mechanism of FIG. 4.
Figure 6:
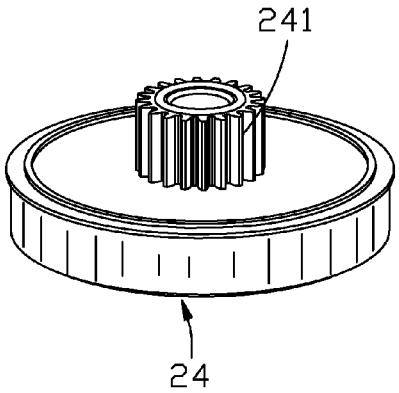
FIG. 6 is a perspective view of a passive wheel of the paper feeding mechanism of FIG. 1.
Figure 7:
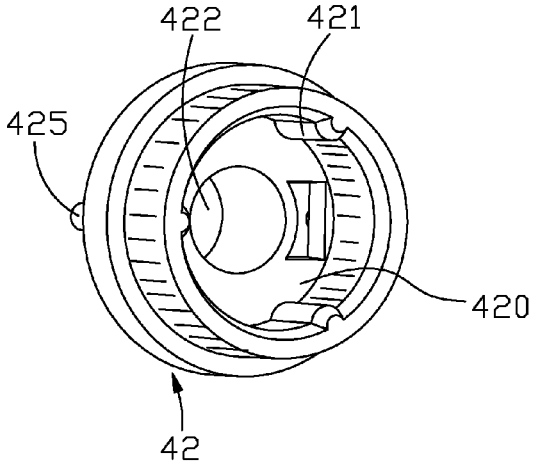
FIG. 7 is a perspective view of a clipping element of the paper feeding mechanism of FIG. 1.
Figure 8:
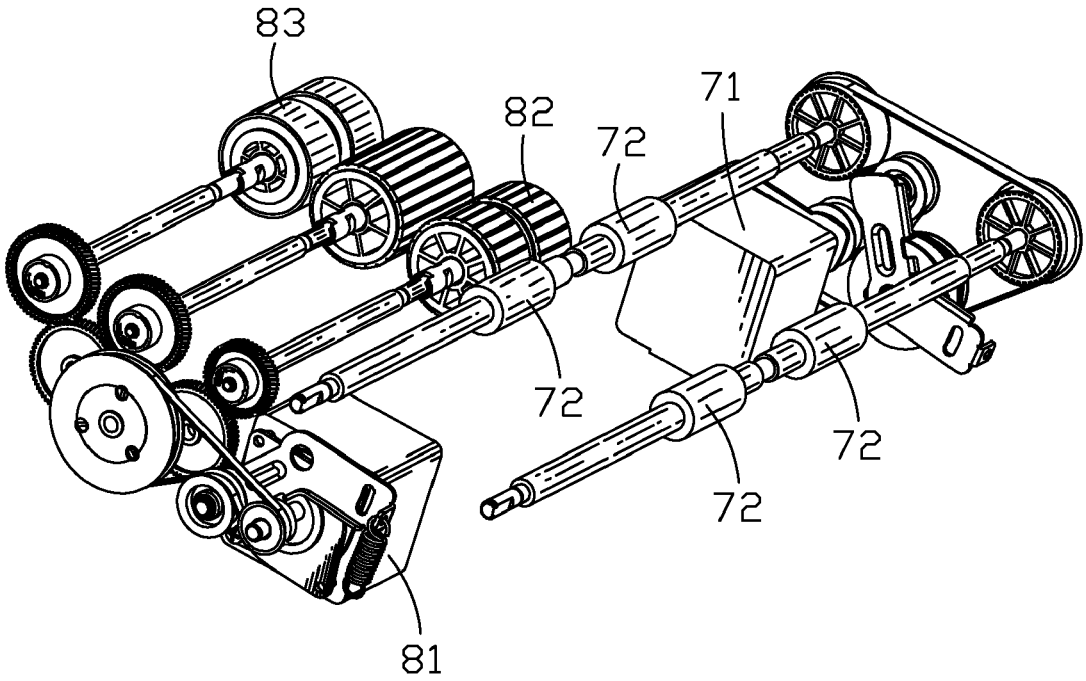
FIG. 8 (Prior Art)
FIG. 8 is a perspective view of a conventional paper feeding mechanism.

Referring to FIG. 3 and FIG. 4, the pickup pressing belt mechanism 25 includes a fan-shaped pickup pressing belt board 251, a pickup elastic element 252 and a pickup pressing belt wheel 253. One end of the pickup pressing belt board 251 defines an inserting hole 2511, and the other end of the pickup pressing belt board 251 defines a sliding groove 2512. A second pillar 2514 is protruded rearward from the pickup pressing belt board 251 and located adjacent to the sliding groove 2512. A middle of one side edge of the pickup pressing belt board 251 is bent rearward to form a fastening piece 2513. The pivoting pillar 523 is inserted into the inserting hole 2511 to pivot the one end of the pickup pressing belt board 251 to the rear side of the second shell 52. A restricting element (not labeled) passes through the sliding groove 2512 to rotatably mount the other end of the pickup pressing belt board 251 to the rear side of the second shell 52. The pickup elastic element 252 is worn around the pivoting pillar 523, and one end of the pickup elastic element 252 hooks the hooking piece 524 and the other end of the pickup elastic element 252 hooks the fastening piece 2513. The pickup conveyer 22 is looped around the second rotating roller 211 of the pickup motor 21 and the passive wheel 24. An outside of the pickup pressing belt wheel 253 slidably presses the pickup conveyer 22. Contraction and expansion of the pickup elastic element 252 drives the pickup pressing belt board 251 to pivot around the pivoting pillar 53 to elastically modulate tightness extent of the pickup conveyer 22. The pickup motor 21 drives the pickup conveyer 22 to bring along the pickup gear 231 and the pickup wheel 233 to rotate along the counter-clockwise direction or a clockwise direction.

Referring to FIG. 3, the separation mechanism 30 driven by the transporting motor 11 includes a separation gear 31, a separation roller 32 and a separation wheel 33. The separation roller 32 is mounted to the second shell 52. The separation gear 31 is mounted to a rear end of the separation roller 32, and the separation wheel 33 is mounted to a front end of the separation roller 32.

Referring to FIG. 3, FIG. 4, FIG. 5 and FIG. 7, one-way clutch mechanism 40 includes a one-way axle 41, a clipping element 42, a wiggling arm 43, a restoration elastic element 44 and a releasing gear 45. The one-way axle 41 is of a ring shape with a through-hole 412 being formed in a center thereof. An outer periphery of the one-way axle 41 defines a plurality of clipping slots 411 axially. The clipping element 42 is of a hollow shape with a mouth 420 being formed in a front of the clipping element 42. An inner periphery of the mouth 420 defines a plurality of ribs 421 matched with the clipping slots 411. A middle of the clipping element 42 defines a center hole 422 vertically penetrating therethrough. A hollow tube 423 is protruded rearward from a periphery of the center hole 422. A bottom of an outer periphery of the tube 423 is spread outward to form a buckling portion 424. A plurality of fastening pillars 425 are protruded rearward from a rear of the clipping element 42, and arranged at regular intervals along a periphery of the rear of the clipping element 42. A lower end of the wiggling arm 43 defines a receiving hole 431, and a plurality of fastening holes 432 distributed around the receiving hole 431. A lower portion of one side edge of the wiggling arm 43 is bent towards a direction perpendicular to the wiggling arm 43 to define a clipping piece 434. A middle of an upper end of the wiggling arm 43 protrudes towards the direction perpendicular to the wiggling arm 43 to form a fixing pillar 433. A top end edge of the wiggling arm 43 is bent towards a direction perpendicular to the wiggling arm 43 and opposite to the clipping piece 434 to form a limiting piece 435. The releasing gear 45 includes a first gear 451 and a second gear 452. The second gear 452 is coaxial with the first gear 451 and disposed opposite to the first gear 451. The first gear 451 is wider than the second gear 452 in diameter. The first gear 451 is mated with the transporting gear 15, and the second gear 452 is mated with the separation gear 31.

The tube 423 of the clipping element 42 is inserted into the receiving hole 431 with the fastening pillars 425 fastened in the fastening holes 432. Then the one-way axle 41 is inserted into the mouth 420 of the clipping element 42 with the ribs 421 clipped in the clipping slots 411 of the one-way axle 41, and the through-hole 412 corresponding to the center hole 422. The tube 423 is inserted into the receiving hole 431 of the wiggling arm 43. The second rotating roller 211 of the pickup motor 21 passes through the through-hole 412, the center hole 422, the receiving hole 431 and the second shell 52 to fasten the lower end of the wiggling arm 43 to the rear side of the second shell 52. So the clipping element 42 can pivot around the second rotating roller 211 together with the one-way axle 41 and the wiggling arm 43. An upper portion of the second shell 52 defines an arc-shaped opening 525. A lower portion of the second shell 52 is punched rearward to define a clamping piece 526. The fixing pillar 433 rotatably passes through in the opening 525 to rotatably mount the upper end of the wiggling arm 43 to the rear side of the second shell 52. The restoration elastic element 44 sleeves around the tube 423. One end of the restoration elastic element 44 connects with the clipping piece 434, and the other end of the restoration elastic element 44 connects with the clamping piece 526. The releasing gear 45 is mounted around the fixing pillar 433 of the wiggling arm 43. The restoration elastic element 44 is elastically expanded to make the wiggling arm 43 return to an original position to drive the first gear 451 engaged with the transporting gear 15, and the second gear 452 engaged with the separation gear 31.

Referring to FIGS. 1-7, specific working action principle of the paper feeding mechanism 100 is described as following. If papers need be fed into the paper feeding mechanism 100, the transporting motor 11 rotates continuously along the counter-clockwise direction to drive the transporting wheel 14 and the transporting gear 15 to rotate continuously along the counter-clockwise direction to feed the papers into the paper feeding mechanism 100.

When there is no paper located under the pickup wheel 233, the pickup motor 21 rotates along the clockwise direction to drive the passive wheel 24 to rotate along the clockwise direction. Then the tooth portion 241 of the passive wheel 24 engages with the pickup gear 231 to drive the pickup wheel 233 to rotate along the counter-clockwise direction to pick up the papers. Because the wiggling arm 43 and the one-way axle 41 have a synchronized rotation, the one-way axle 41 shows a static status. In the meanwhile, the upper end of the wiggling arm 43 is located in a highest position with the limiting piece 435 resisting against an upper inner end of the opening 55 to make the first gear 451 and the second gear 452 of the releasing gear 45 engaged with the transporting gear 15 and the separation gear 31, respectively. Thus, the transporting motor 11 rotates continuously along the counter-clockwise direction to drive the transporting gear 15 to rotate continuously along the counter-clockwise direction to bring along the releasing gear 45 and the separation gear 31 to rotate along the clockwise direction and counter-clockwise direction, respectively. The separation gear 31 brings along the separation wheel 33 to separate the papers picked up by the pickup wheel 233 so as to ensure the papers to be transported to the transporting wheel 14 piece by piece.

When there is some papers located under the pickup wheel 233, the pickup motor 21 stops rotating. So the pickup wheel 233 and the one-way axle 41 show static statuses. In the same way, the transporting motor 11 rotates continuously along the counter-clockwise direction to drive the transporting gear 15 to rotate continuously along the counter-clockwise direction to bring along the releasing gear 45 and the separation gear 31 to rotate along the clockwise direction and counter-clockwise direction, respectively. The separation gear 31 brings along the separation wheel 33 to separate the papers picked up by the pickup wheel 233 so as to ensure the papers to be transported to the transporting wheel 14 piece by piece.

When the paper feeding mechanism 100 is in a buffer-full condition, the transporting motor 11 rotates along the clockwise direction to drive the transporting wheel 14 to rotate along the clockwise direction to bring the papers out. The pickup motor 21 rotates along the counter-clockwise direction to drive the one-way axle 41 to rotate along the counter-clockwise direction to bring along the wiggling arm 43 to rotate along the counter-clockwise direction. At that case, the upper end of the wiggling arm 43 wiggles downward with the limiting piece 435 resisting against an lower inner end of the opening 55 to let the releasing gear 45 apart away from the transporting gear 15 and the separation gear 31 so as to make the separation wheel 33 stop rotating. At the same moment, the pickup motor 21 rotates along the clockwise direction to drive the pickup wheel 233 to rotate along the clockwise direction to pull the papers out of the paper feeding mechanism 100. When the papers need be fed into the paper feeding mechanism 100 again, the transporting motor 11 rotates along the counter-clockwise direction to drive the transporting wheel 14 to rotate along the counter-clockwise direction to feed the papers into the paper feeding mechanism 100. The pickup motor 21 rotates along the clockwise direction to make the one-way axle 41 static. The wiggling arm 43 returns to the original position under the action of the restoration elastic element 44 to drive the first gear 451 engaged with the transporting gear 15, and the second gear 452 engaged with the separation gear 31 again.

The opening 55 can limit rotating angle of the wiggling arm 43 to prevent the wiggling arm 43 rotating downward excessively to fall off, and the wiggling arm 43 rotating upward under the action of the restoration elastic element 44 to make the first gear 451 engaged with the transporting gear 15, and the second gear 452 engaged with the separation gear 31 over tightly.

As described above, the paper feeding mechanism 100 depends on the one-way clutch mechanism 40 being rotatably mounted to the shell 50 to realize the transporting motor 11 to synchronously drive the transporting gear 15 and the separation wheel 33 to rotate continuously. As a result, paper feeding time is saved to decrease a space between each two pieces of the papers fed to the paper feeding mechanism 100 so as to improve a paper feeding speed. Therefore, the paper feeding mechanism 100 uses fewer components to design a proper structure to realize a better working performance.

What is claimed is:

1. A paper feeding mechanism, comprising:

a pickup mechanism mounted to a shell, the pickup mechanism including a pickup motor having a rotating roller, a pickup roller driven by the pickup motor, and a pickup wheel mounted around the pickup roller;

a transporting mechanism mounted to the shell, the transporting mechanism including a transporting motor, at least one transporting roller driven by the transporting motor, a plurality of transporting wheels mounted around the transporting roller, and a transporting gear mounted to one end of the transporting roller;

a separation mechanism mounted to the shell and driven by the transporting motor, the separation mechanism including a separation roller, a separation gear mounted to one end of the separation roller, and a separation wheel mounted to the other end of the separation roller; and a one-way clutch mechanism mounted to the shell, the one-way clutch mechanism including a one-way axle, a wiggling arm, a restoration elastic element and a releasing gear, the one-way axle passing through one end of the wiggling arm, the rotating roller of the pickup motor passing through the one-way axle to fasten the one end of the wiggling arm to the rotating roller of the pickup motor, the other end of the wiggling arm being rotatably mounted to the shell, the restoration elastic element being fastened between the wiggling arm and the shell, the releasing gear being mounted to the other end of the wiggling arm, and engaged with the transporting gear and the separation gear.

2. The paper feeding mechanism as claimed in claim 1, wherein a top end edge of the wiggling arm is bent towards a direction perpendicular to the wiggling arm to form a limiting piece, an upper portion of the shell defines an arc-shaped opening, the other end of the wiggling arm is rotatably mounted to the shell by means of the limiting piece rotatably passing through the opening.

3. The paper feeding mechanism as claimed in claim 1, wherein an upper end of the wiggling arm protrudes towards a direction perpendicular to the wiggling arm to form a fixing pillar, the releasing gear is mounted around the fixing pillar.

4. The paper feeding mechanism as claimed in claim 1, wherein the one-way clutch mechanism further includes a clipping element, the clipping element is of a hollow shape with a mouth being formed in a front thereof, an inner periphery of the mouth defines a plurality of ribs, the clipping element defines a center hole, a hollow tube is protruded rearward from a periphery of the center hole, the one-way axle is of a ring shape with a through-hole being formed in a center thereof, an outer periphery of the one-way axle defines a plurality of clipping slots axially, a lower end of the wiggling arm defines a receiving hole for receiving the tube, the one-way axle is inserted into the mouth of the clipping element with the ribs clipped in the clipping slots, and the through-hole corresponding to the center hole, the rotating roller of the pickup motor passes through the through-hole, the center hole, the receiving hole and the shell to make the clipping element pivot around the rotating roller together with the one-way axle and the wiggling arm.

5. The paper feeding mechanism as claimed in claim 4, wherein one side edge of the wiggling arm bends towards a direction perpendicular to the wiggling arm to define a clipping piece, a lower portion of the shell is punched rearward to define a clamping piece, the restoration elastic element is worn around the tube, and connects between the clipping piece and the clamping piece.

6. The paper feeding mechanism as claimed in claim 5, wherein the releasing gear includes a first gear and a second gear coaxial with the first gear and narrower than the first gear in diameter, the first gear is engaged with the transporting gear, and the second gear is engaged with the separation gear under an action of the restoration elastic element.

7. The paper feeding mechanism as claimed in claim 1, wherein the pickup mechanism further includes a pickup conveyer driven by the pickup motor, a passive wheel driven by the pickup conveyer, a pickup gear and a pickup pressing belt mechanism, the pickup roller is mounted in the pickup gear, the pickup motor and the passive wheel are mounted to the shell, the passive wheel has a tooth portion engaged with the pickup gear.

8. The paper feeding mechanism as claimed in claim 7, wherein a side edge of the shell is punched rearward to define a hooking piece, a pivoting pillar is protruded rearward from the shell, the pickup pressing belt mechanism includes a fan-shaped pickup pressing belt board, a pickup elastic element and a pickup pressing belt wheel, the pickup pressing belt board defines an inserting hole and a sliding groove, a second pillar is protruded rearward from the pickup pressing belt board and located adjacent to the sliding groove, one side edge of the pickup pressing belt board is bent rearward to form a fastening piece, the pivoting pillar is inserted into the inserting hole to pivot the one end of the pickup pressing belt board to a rear side of the shell, a restricting element passes through the sliding groove to rotatably mount the other end of the pickup pressing belt board to the rear side of the shell, the pickup elastic element is worn around the pivoting pillar, and hooks between the hooking piece and the fastening piece, the pickup conveyer is looped around the rotating roller of the pickup motor and the passive wheel, an outside of the pickup pressing belt wheel slidably presses the pickup conveyer.

9. The paper feeding mechanism as claimed in claim 1, wherein the shell defines a guiding piece, and two L-shaped clamping pieces disposed face to face, the transporting mechanism further includes a transporting conveyer driven by the transporting motor and a transporting pressing belt mechanism, the transporting pressing belt mechanism further includes a transporting pressing board, a transporting elastic element and a transporting pressing wheel, the transporting pressing board defines a guiding slot and a limiting slot, one end of the transporting pressing board is bent forward to define a blocking piece, a first pillar is protruded forward from a front of the transporting pressing board and located between the guiding slot and the limiting slot, the one end of the transporting pressing board is positioned between the two clamping pieces, the guiding piece is inserted into the guiding slot, a limiting element passes through the limiting slot to slidably dispose the other end of the transporting pressing board to a front side of the shell, the transporting elastic element hooks between the blocking piece and the guiding piece, the transporting pressing wheel is mounted around the first pillar, a front end of the transporting roller is equipped with a rotating wheel, the transporting conveyer is looped around a rotating roller of the transporting motor and the rotating wheel, an outside of the transporting pressing wheel slidably presses the transporting conveyer.

* * * * *